United States Patent [19]

White et al.

[11] Patent Number: 4,796,331

[45] Date of Patent: Jan. 10, 1989

[54] HINGE FOR ROOF WINDOW

[75] Inventors: Paul S. White, Barnsley; Michael D. Eaton, Wigan, both of United Kingdom

[73] Assignee: GKN Crompton Limited, Lancashire, England

[21] Appl. No.: 139,723

[22] Filed: Dec. 30, 1987

[51] Int. Cl.[4] ..... E05D 11/06; E05D 11/08; E05D 11/10

[52] U.S. Cl. ..... 16/324; 16/333; 16/334; 16/339; 16/360; 16/371

[58] Field of Search ..... 16/321, 323, 324, 327, 16/333, 334, 337, 360, 339, 343, 349, 357, 374, 375, 361, 345, 363, 364, 366, 371, 338; 49/388

[56] References Cited

U.S. PATENT DOCUMENTS

| | | | |
|---|---|---|---|
| 897,449 | 9/1908 | Bogenberger | 16/375 |
| 1,648,331 | 8/1925 | Soule | 16/360 |
| 1,876,402 | 9/1932 | Cramer | 16/364 |
| 3,389,502 | 6/1968 | Leurent | 49/388 |

FOREIGN PATENT DOCUMENTS

| | | | |
|---|---|---|---|
| 397284 | 8/1933 | United Kingdom | 16/338 |

*Primary Examiner*—Fred A. Silverberg
*Assistant Examiner*—William Scott Andes
*Attorney, Agent, or Firm*—Marshall, O'Toole, Gerstein, Murray & Bicknell

[57] ABSTRACT

A hinge primarily for a roof window with a pivotally opening sash comprises a body to be fixed to the frame of the window, a support member pivoted to the body and arranged to be secured to the sash, a stay member pivoted to the support member spaced from its connection to the body, and constraining mechanism comprising a frictional assembly and positive catch mechanism to hold at least one position of the sash. As the sash is pivoted, the stay member has one end moved in an arc by the support member while its other end is constrained to reciprocation within the body. The catch mechanism may be operable from a remote position on the frame.

12 Claims, 8 Drawing Sheets

FIG. 7.
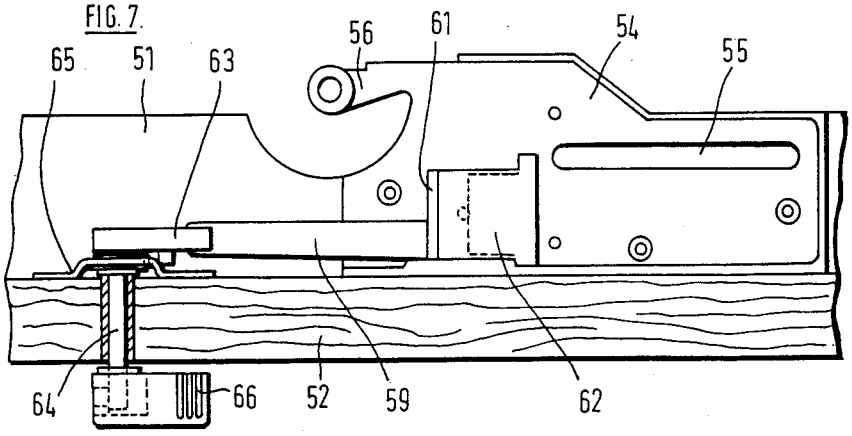
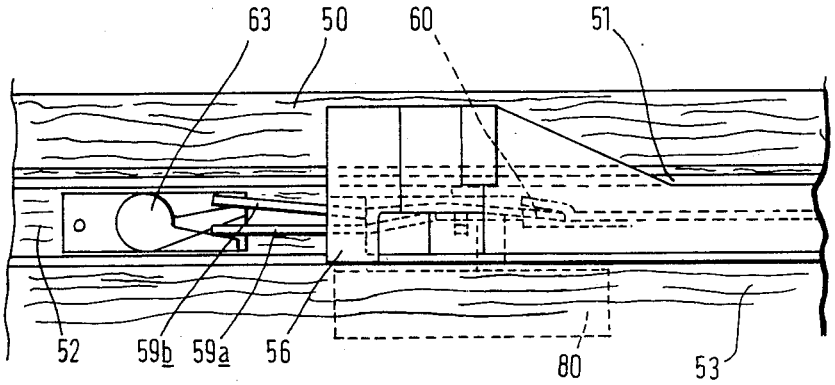
FIG. 8.

HINGE FOR ROOF WINDOW

BACKGROUND TO THE INVENTION

FIELD OF THE INVENTION

This invention relates to a hinge intended primarily, although not exclusively, for a roof window of the kind wherein a glazed sash is pivotally openable relative to a fixed peripheral frame, about an axis extending transversely of the fixed frame in the centre region thereof. The usual mode of installation of such a window in a conventional sloping roof is that the pivot axis of the opening sash lies horizontally, mid-way between upper and lower edges of the sash.

In such a roof window, the disposition of the pivot axis of the sash mid-way between the upper and lower edges thereof is to enable the sash to be pivoted through an angle approaching 180 degrees from the closed position, to enable cleaning from inside the building of the glass surface which is the external surface when the window is closed. It will be appreciated that access for cleaning the exterior of a roof window usually would be somewhat difficult if the window were not capable of so opening.

Several other design constraints exist in respect of roof windows. It is usual to provide a window with covering elements, which may be in the form of sheet metal components commonly termed cassettes, to provide weather protection for the joint faces between the opening sash and the fixed frame. Weather seals, of course, are also provided at such joint faces. In any event, the hinges used must not interfere with the fitting of the cassettes. Further, the hinges should be capable of affording a, preferably adjustable, frictional resistance to pivoting of the sash so that it will hold a desired position between its fully open and fully closed positions, against possible unbalance of the sash and external effects such as wind. Desirably also at least one positive stop is provided for the sash to maintain a fully opened (reversed) position for cleaning purposes and a slightly open vent position.

SUMMARY OF THE INVENTION

It is the object of the present invention to provide a hinge which meets such requirements for a roof window, and it will be appreciated that in achieving this the hinge is suitable for use more generally where there are similar or analogous requirements.

According to the invention, we provide a hinge for a window comprising a sash openable relative to a peripheral frame about a pivot axis extending transversely of the frame in the mid-region between upper and lower edges thereof, said hinge comprising:

a body adapted to be secured to said peripheral frame and affording a pivot formation;

support means pivotally connected to said body at said pivot formation and adapted to be connected to said sash to support the latter, said support means also affording a further pivot formation spaced from said first pivot formation to move in an arcuate path thereabout;

a stay member having one end connected to said support means at said further pivot formation and its other end constrained for reciprocation within the body; and constraining means arranged to engage said stay member within said body to constrain movement thereof at least one operative position of the stay member.

In a hinge according to the invention, the arrangement by which the constraining means cooperates with the stay member within the body of the hinge has the principal advantage that the constraining means is away from and does not interfere with the interfitting cassettes protecting the window.

Preferably the constraining means comprises:

friction means engaging said stay member frictionally to constrain movement thereof, and catch means engagable with said stay member to prevent movement thereof at least one operative position thereof.

In the following description of embodiments of the invention, the friction means is capable of providing a frictional resistance to movement of the stay member which is adjustable. Further, the frictional resistance to movement can be arranged to vary as the window moves between its fully closed and fully opened conditions.

The catch means, which may comprise a catch member spring biased into engagement with the stay member and manually releasable therefrom, preferably engages the stay member at positions corresponding to the fully open position of the window, for cleaning as aforesaid, and to a slightly open vent position.

The window may be provided with a fastener of conventional type, e.g. a cockspur fastener, to hold it in the fully closed position.

The support means of the hinge may include a member quickly detachable from the sash of the window. For example, the support means may include a socket or housing assembly fixed to the sash, and receiving an element pivoted to the hinge body. This enables the sash to be readily demounted from the fixed frame if required, without necessitating the removal of a large number of fasteners.

The catch member of the hinge may be operable from a position on the peripheral frame of the window which is remote from the hinge. This enables the hand of someone opening or closing the window to kept well away from the region of the hinge during such operation, to avoid the possibility of accidental contact with the window sash.

BRIEF DESCRIPTION OF DRAWINGS

These and other features of the invention will now be described by way of example with reference to the accompanying drawings, of which:

FIGS. 7, 8 and 9 are diagrammatic partial views of a further embodiment of hinge according to the invention;

DESCRIPTION OF PREFERRED EMBODIMENTS

Figure 1:
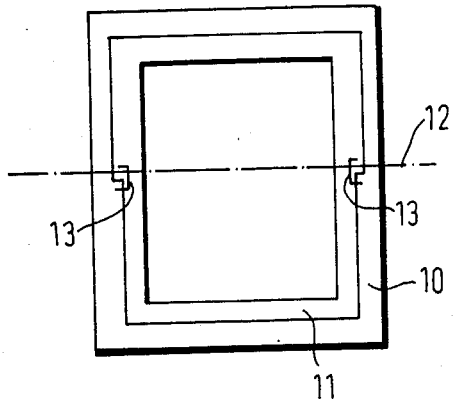
FIG. 1 is a diagrammatic elevation of a window to which a hinge according to the invention may be applied.

Referring firstly to FIG. 1 of the drawings, there is shown a window comprising a fixed peripheral frame 10 and a glazed sash 11 therein. The sash is openable by pivoting about an axis 12 extending transversely across the window, substantially mid-way between the top and bottom thereof. If the window is a roof window there would be provided weather protection elements, but these are not here shown.

The sash 11 is supported relative to the frame 10 by a pair of hinges which are mirror images of one another, and one of which is described hereafter. Each hinge comprises a body fixed to the frame 10, and a support means pivotally connected to the body, which support means is in the form of a generally U-shaped element means 13. The limbs of the two U-shaped elements face outwardly opposite one another. The U-shaped elements may be quickly detachable from the sash 11, e.g. by being received in sockets afforded by components secured to the sash, and held in such sockets by a readily releasable fastening means.

Figure 6:
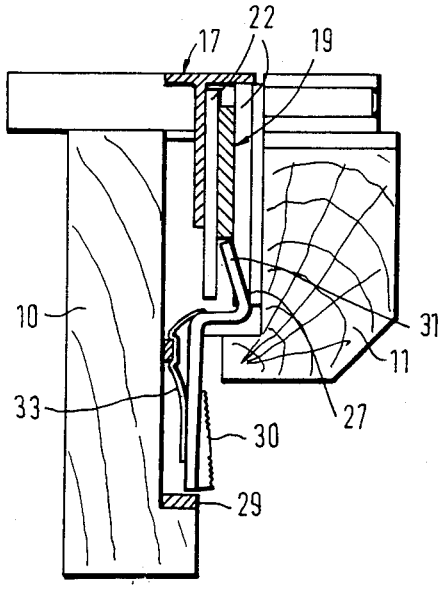
FIG. 6 is a section on the line 6—6 of FIG. 3.

Referring now to FIGS. 2 to 6 of the drawings, one of such U-shaped elements is indicated at 13, with its two parallel limbs at 14, 15. The hinge comprises a body 17 in the form of a shallow elongate open topped box, adapted to be secured to a recess in the frame 10 by screws passing through holes 16 in the base of the body. A removable cover member, not shown, would be provided to conceal the parts disposed in the hinge body 17, as described hereafter. In FIG. 6, the frame 10 is illustrated as is the sash 11. The body includes a portion 18 which at its free end has an aperture within which the end of limb 14 of element 13 is pivotally received, and held captive.

The free end of the other limb 15 of the U-shaped element 13 is pivotally connected to one end of a sheet metal stay member 19. The other end of the stay member carries a rivet or peg 20 which engages in an elongate slot 21 in the base of the body, so that the end of the stay member 19 is constrained to reciprocation within the body. Between its ends, the stay member 19 passes between friction means in the form of two friction plates 22 held together by screws 23, 24. The stay member 19 has a recess 25 in its side, and an abutment surface 26 adjacent its pivotal connection to element 13.

The body 17 also supports a catch member 27. This has a portion 28 which lies within a lateral extension 29 of the body 17, and is provided with a thumb pad 30, and a portion 31 with an end surface 32. The catch member 27 is spring biased in the anti-clockwise sense, with regard to FIG. 6 of the drawings, by a spring blade 33 disposed therebeneath in the body 17.

Figure 2:
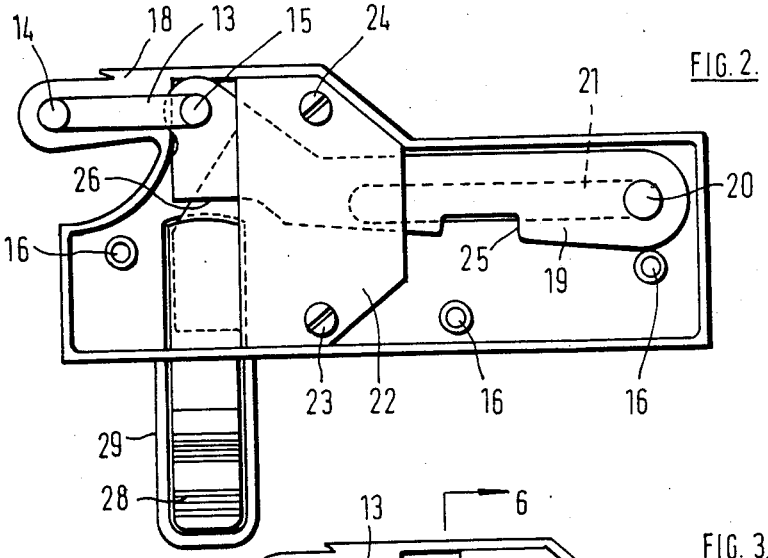
FIGS. 2 to 5 are plan views of a hinge according to the invention, showing the parts thereof in successive stages of operation.

When the sash of the window is fully closed, the parts of the hinge are in the relative positions shown in FIG. 2 of the drawings. A separate fastening means, e.g. a cockspur fastener, may be provided on the window, cooperating with the sash and fixed frame to fasten the window in such position.

Figure 3:
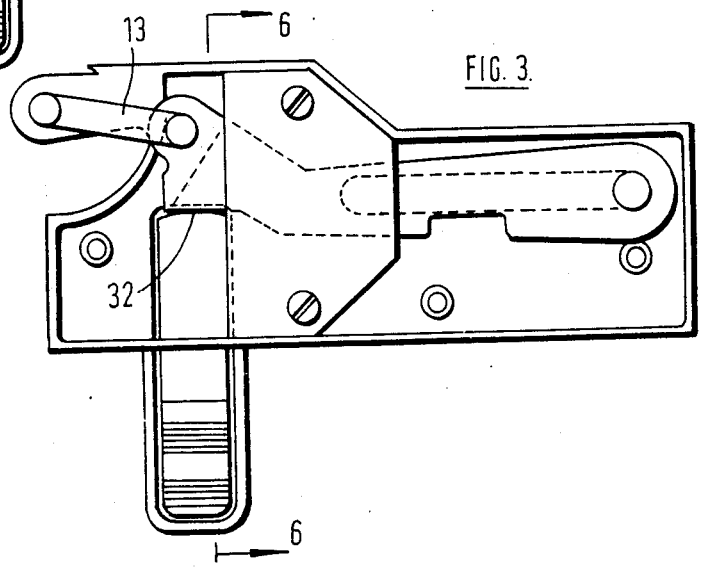
Figure 4:
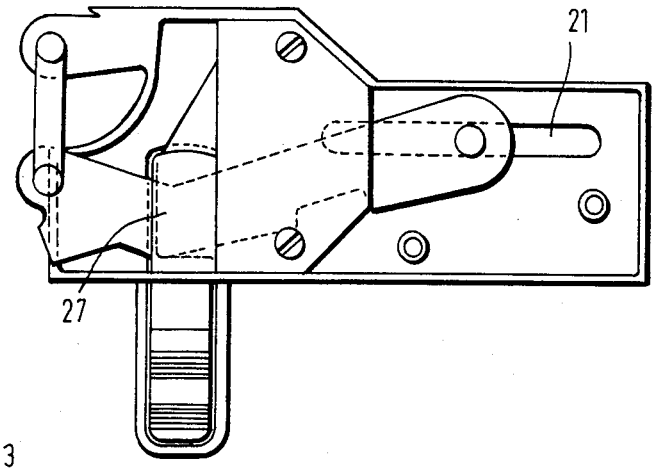
Figure 5:
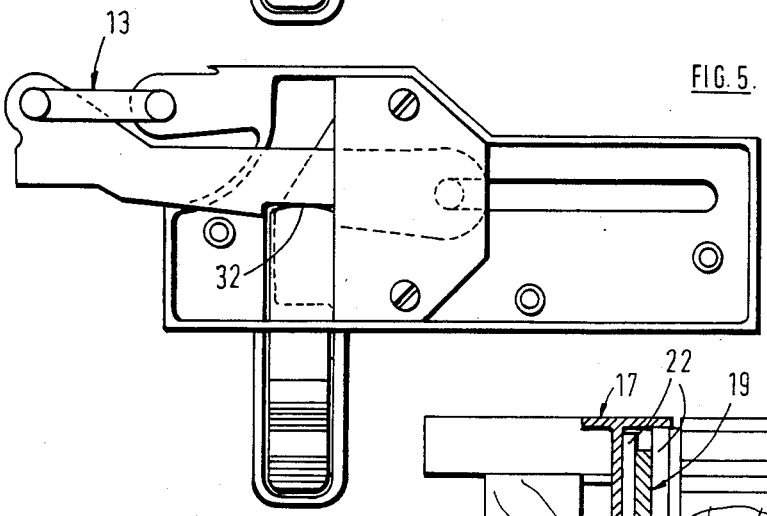

As the window is opened from such fully closed position, the position shown in FIG. 3 of the drawings is reached. Here the end surface 32 of the catch member abuts the surface 26 on the stay member 19, to provide a positive stop to prevent the sash being opened further. This gives a secure vent position.

If the window is to be opened farther, catch member 27 must be moved against the biasing of spring 33 by pressing the thumb push 30. This disengages the abutting surfaces 32, 26, permitting the window to be opened to the position represented by FIG. 4 and beyond to the fully open position shown in FIG. 5 of the drawings. In the fully open position, the end 32 of the catch member enters recess 25 in the stay member 19, so as positively to hold the position in which the sash has been pivoted through substantially 180 degrees from the closed position. This permits cleaning of the glazed surface which normally is on the exterior of the building.

Through the whole range of movement of the hinge, there is a frictional resistance to such movement caused by the frictional grip of stay member 19 between the friction plates 22. The magnitude of frictional force can be determined by the extent to which screws 23, 24 are tightened. Further, if such screws are tightened to different extents a different frictional force can be obtained at different window positions. For example, if screw 23 is tightened more than screw 24, a greater frictional force is obtained when the window is in the position shown in FIG. 4 of the drawings, as compared with the positions of FIGS. 2, 3 and 5. Screw 24 may be tightened more tan screw 23 to obtain a greater frictional force at the latter positions.

It will be appreciated that a window uses a pair of hinges having the parts and configuration as described above, but mirror images of one another. Only one of such hinges need have a catch member and the associated body extension and biasing spring.

Referring now to FIGS. 7 onwards of the drawings, there is shown a modification of the hinge according to the invention, used in a window assembly in which there is an intermediate frame relative to which the glazed sash is pivotally openable, the intermediate frame itself, with the sash carried thereby, being openable relative to a fixed frame. In a roof window such a structure provides for the normal pivotal opening of the sash, about an axis extending transversely in the centre region thereof, for ventilation and cleaning as above described, whilst the opening of the sash and intermediate frame together, about a transversely extending axis which normally will be adjacent the uppermost end of the window, provides a large opening to give a means of escape in the case of an emergency such as a fire. The modification of the hinge, hereafter described, enables the hinge to be operated from a remote position in the frame structure of such a window. In FIGS. 7 and 8, parts of the hinge have been omitted for clarity.

Figure 9:
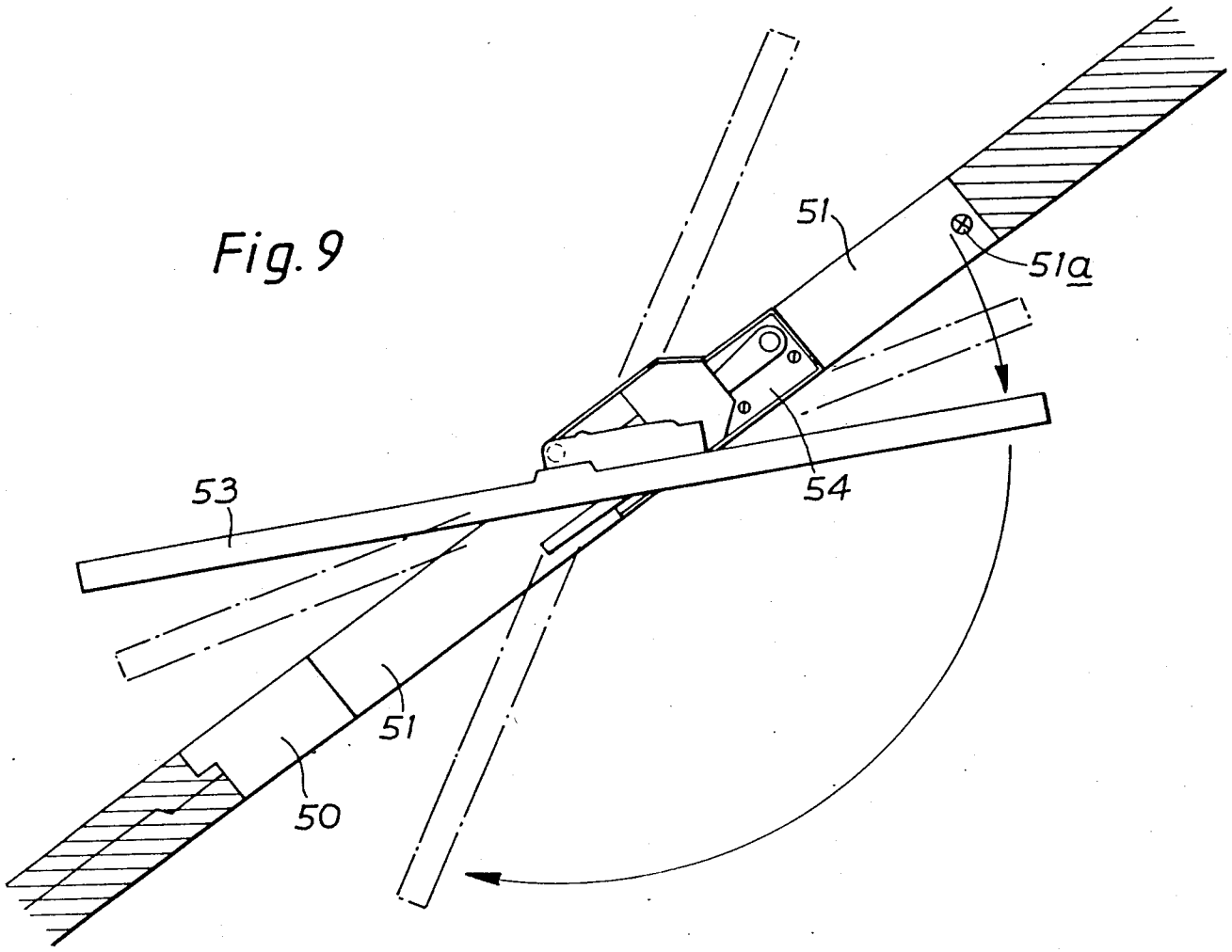

In FIGS. 7 and 8, one of the side members of the fixed main frame of the window is indicated at 50. Hinged to the fixed frame is an intermediate frame member 51 which is a metal strip pivotable relative to the fixed frame member 50 about an axis which in use extends transversely at the uppermost end of the window, at 51*a* in FIG. 9. A timber rail 52 is secured to the frame member 50, and in FIGS. 8 and 9 of the drawings a side member of the frame of the pivotally openable sash is indicated at 53.

Figure 10:
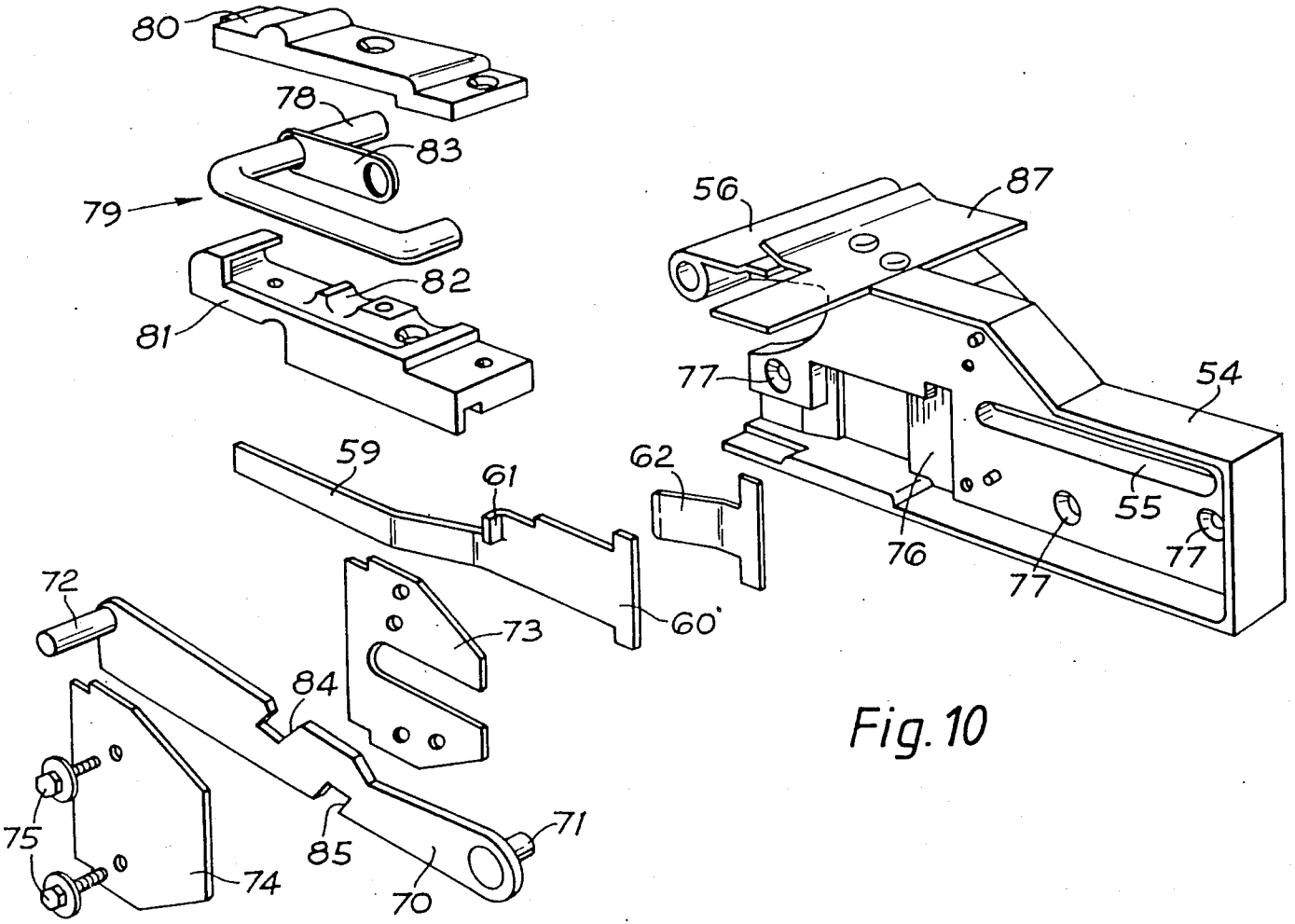
FIG. 10 is a completely partly exploded perspective view of the main parts of the hinge of FIGS. 7, 8, and 9.
Figure 11:
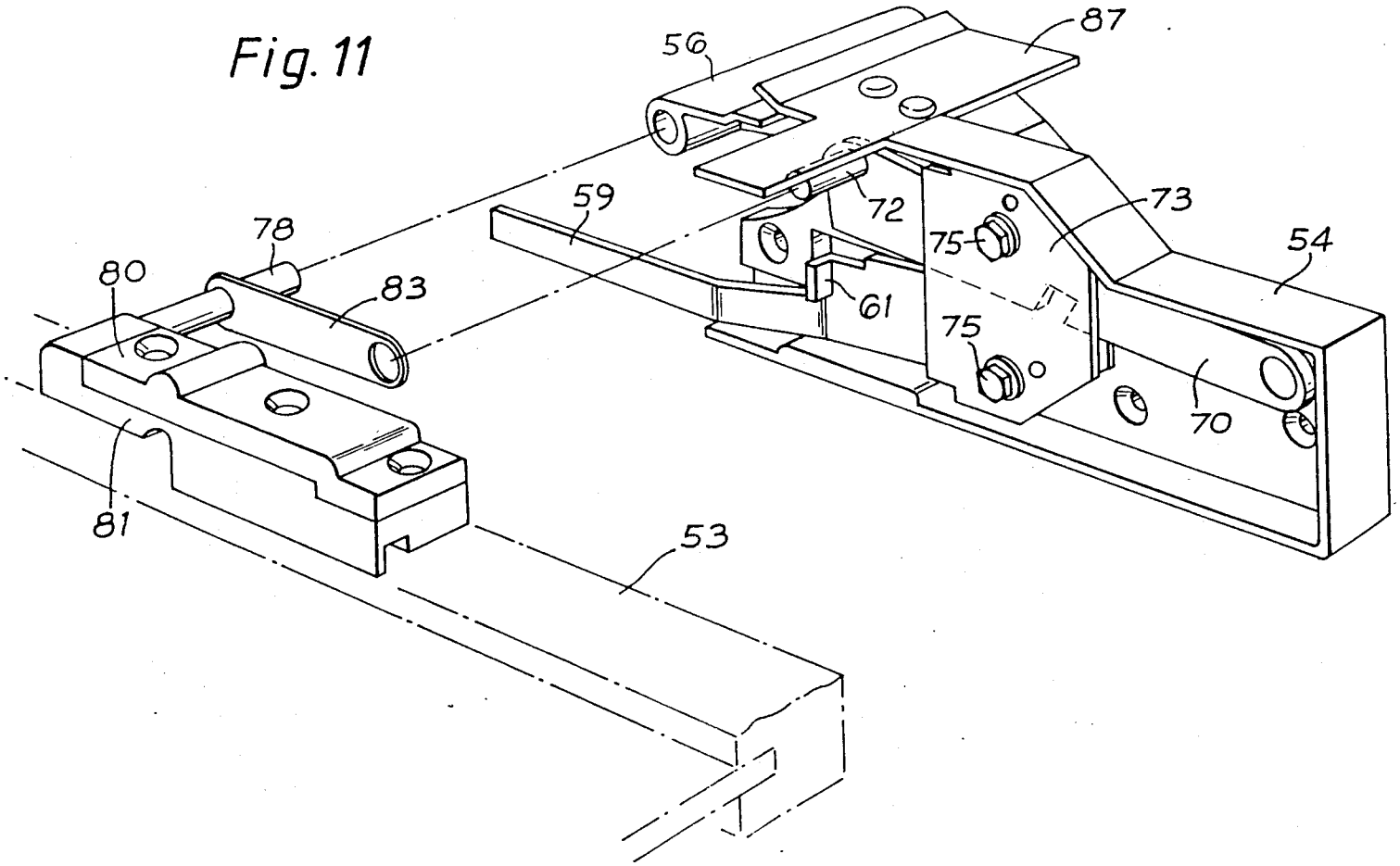
FIG. 11 is a partly exploded perspective view of the main parts of the hinge of FIGS. 7, 8 and 9.

Referring now additionally to FIGS. 10 and 11, the sash is pivotable relative to the intermediate frame by a hinge comprising a hinge body 54 which is secured to the intermediate frame member 51. The hinge body 54 is somewhat similar to the hinge body 17 above described in relation to FIGS. 2 to 6, including a slot 55 corresponding to the slot 21. The hinge further comprises a stay member 70 which is provided at one end with a pin 71 received in and slidable along the slot 55, and at its other end with an oppositely directed pin 72 to be described hereafter. The stay member 70 passes between friction plates 73, 74 held to the hinge body 54 by bolts 75 which are adjustable to vary the frictional resistance to movement of the stay member, as above described. The hinge body also supports a catch arm 59 whose one end 60 is formed as a generally T-shaped enlargement, and is received in a recess 76 in the hinge body. A spring plate 62 is disposed behind the catch arm 59 in the hinge body, to spring bias the catch arm as described hereafter.

The hinge body 54 has apertures 77 to receive fasteners for holding it to the intermediate frame member 51.

The lug 56 of the hinge body receives, for pivoting therein, a limb 78 of a support means which comprises a generally U-shaped element 79 and a housing having two parts 80, 81. The element 79 is able to be clamped between the two parts 80, 81 of the housing, which is secured to the sash frame member so that the sash frame member is pivotally supported relative to the hinge body 54. The U-shaped element 79 lies in a correspondingly shaped recess in the two housing parts 80, 81, so that it is firmly held therein. The housing parts 80, 81 also define a recess 82 for receiving the pin 72 at the end of the stay member 70 so that when the sash is pivoted as described hereafter, the pin 72 is caused to move in an arcuate path about the axis provided by the limb 78 engaged in lug 56 of the hinge body. A bracing member 83 extends between the limb 78 and pin 72, to ensure alignment and correct spacing between these parts.

As above described, the catch arm 59 extends along the intermediate frame member 51. At its end opposite the end 60, the catch arm is engagable by a striker 63 provided on the end of a shaft 64 extending through an aperture in the rail 52 and supported by a bracket 65, the shaft 64 being movable angularly by a manually operable release lever 66. The release lever 66 is positioned so as to be accessible from the interior of the building wherein the window is installed, and, since it is mounted to the rail 52 and thus to the fixed frame member 50, remains stationary even if the intermediate frame of the window should be pivoted about its axis 51*a*. When the intermediate frame 51 is in its normal position, as illustrated, the striker 63 is able to operate the catch arm 59.

Adjacent its end 60, the catch arm has a flange or lug 61 which is engagable with the stay member 70.

In FIG. 8, two operative positions of the catch arm 59 are shown. In position 59*a*, to which the catch arm is biased by the spring plate 62, the flange formation 61 is engagable with the stay member of the hinge. Operation of lever 66 and thus the striker 63 moves the catch arm to position 59*b*, wherein flange formation 61 is retracted from the stay member of the hinge, permitting the sash to pivot about its axis provided by the U-shaped member 57 engaging in lug 56. The release lever 66 is clear of the sash when it thus pivots, so that the hand of an operator is safe from contact with the pivoting sash.

Figure 12:
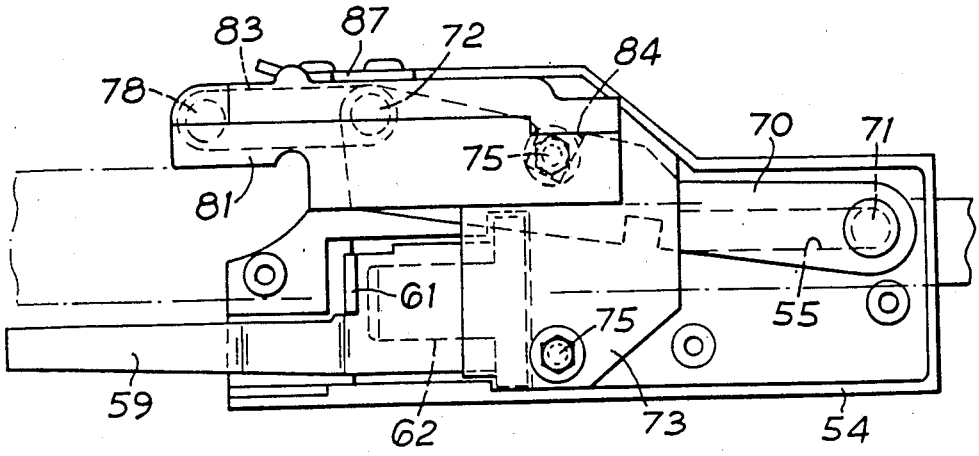
FIGS. 12 to 15 are views of the hinge of FIG. 7 onward, showing successive operational positions thereof.

Four successive operative positions of the hinge above described are shown in FIGS. 12 to 15. FIG. 12 shows the disposition of the parts of the hinge whilst the sash is in its fully closed position. The U-shaped element 79 lies substantially parallel to the slot 55 in the hinge body, and in this position it will be noted that the stay member 70 has an over-centre position with respect to the pivot points provided by pins 71 and 72, and the limb 78 engaging in lug 56. A cutout 84 in the stay member 70 accommodates the uppermost bolt 75 by which the friction plates 73, 74 are held to the hinge body. Although the overcentre disposition of the stay member 70 would tend to provide a force to resist pivoting of the sash from this position, there would be provided a suitable fastening for holding the sash in such closed position.

Figure 13:
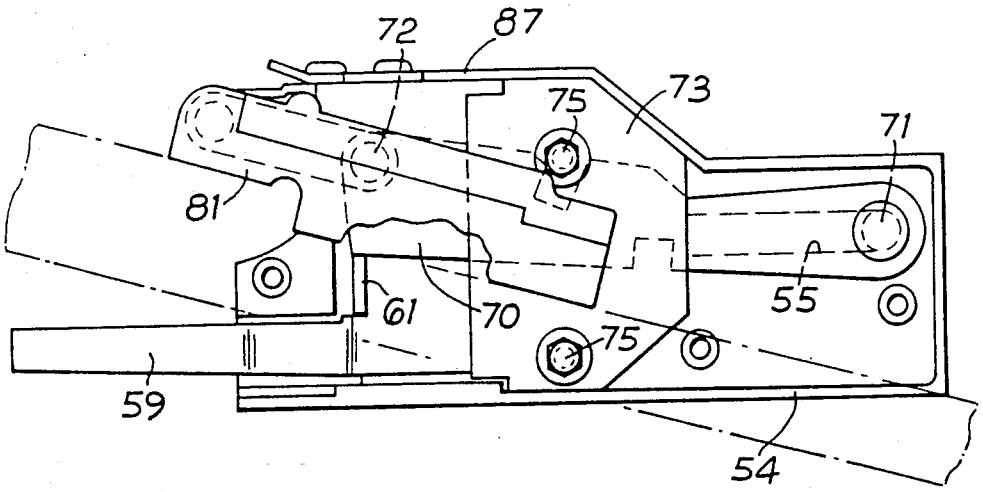
Figure 14:
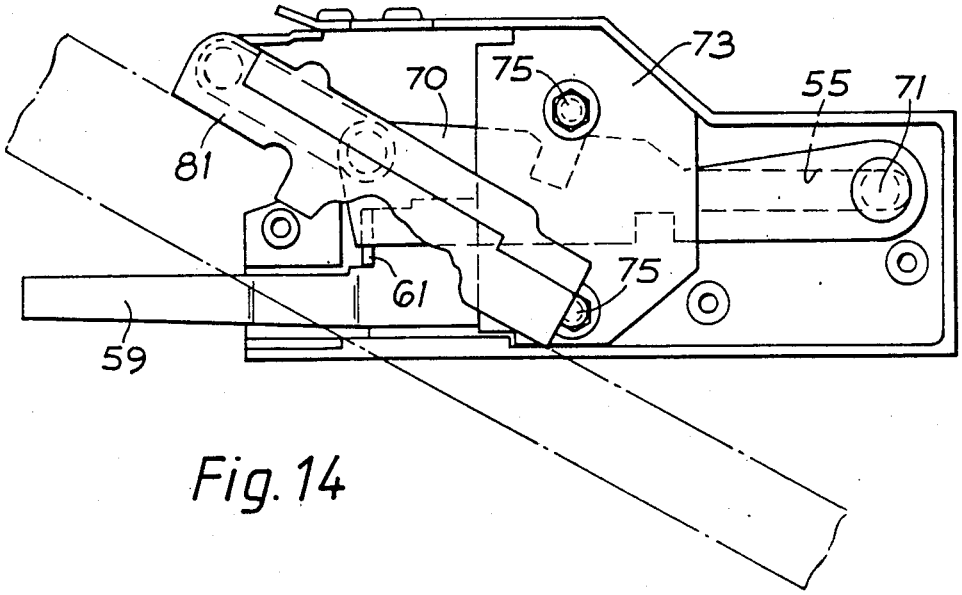

As the sash opens about the pivot provided by limb 78 engaging in lug 56, the position shown in FIG. 13 is reached. Pin 72 moves downwardly until the stay member abuts the flange 61 provided on the catch arm 59. This prevents further movement of the stay member and thus further opening of the sash. A secure position for the sash is thus provided at which some ventilation can be achieved through a small opening thereof.

For further opening of the sash, the release lever 66 must be operated to retract the catch arm to its position 59*b*. Further opening of the sash is then possible, during which the stay member slides between the friction plates 73, 74 as its pin 71 moves along the slot 55. During such movement, the frictional resistance thereto given by the friction plates 73, 74 is adjustable by the bolts 75, which may be tightened to different extents so that the frictional resistance varies as the sash is moved.

Figure 15:
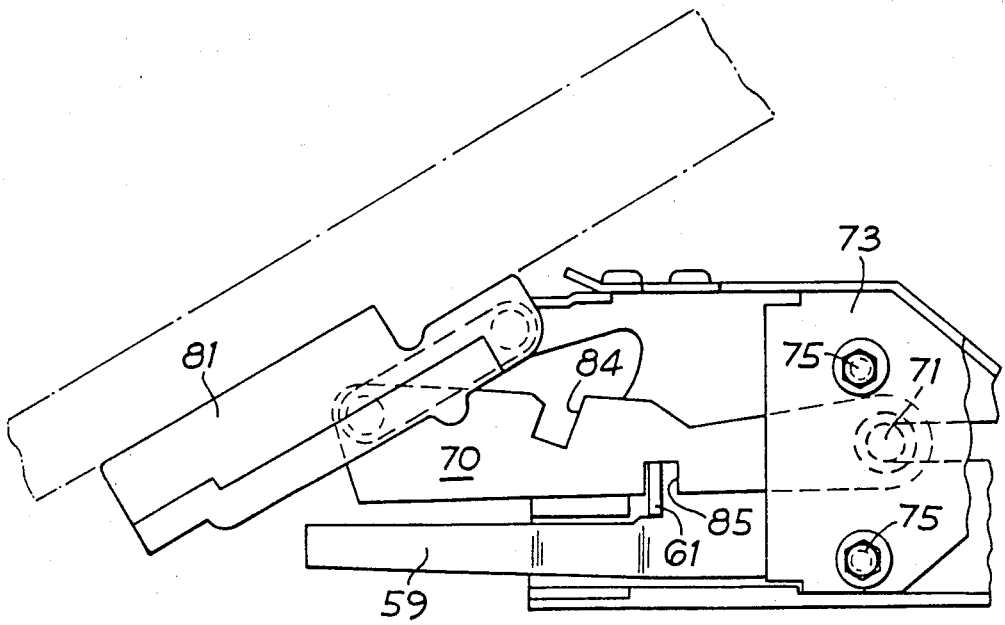

FIG. 15 shows a fully open position of the sash. In this position, flange 61 of the catch arm 60 engages a notch 85 in the stay member 70, so that the sash is held in such position. When it is required to close the sash from this position, it is again necessary to operate the release lever 66 and move the catch arm, against the force of its biasing spring 62, to its position indicated at 59*b* in FIG. 8.

We claim:

1. A hinge for a window comprising a sash openable relative to a peripheral frame about a pivot axis extending transversely of the frame in the mid-region between upper and lower edges thereof, said hinge comprising:

a body adapted to be secured to said peripheral frame and affording a first pivot formation;

support means pivotally connected to said body at said first pivot formation and adapted to be connected to said sash to support the latter, said support means also affording a further pivot formation spaced from said first pivot formation to move in an arcuate path thereabout;

a stay member having one end connected to said support means at said further pivot formation and its other end constrained for reciprocation within the body; and constraining means arranged to engage said stay member within said body to constrain movement thereof at least one operative position of the stay member.

2. A hinge according to claim 1 wherein said constraining means comprises:

friction means engaging said stay member frictionally to constrain movement thereof; and catch means engagable with said stay member to prevent movement thereof at least one operative position thereof.

3. A hinge according to claim 2 wherein there is provided means for adjusting said friction means to vary the frictional resistance provided thereby to movement of the stay member.

4. A hinge according to claim 3 wherein the friction means is positioned in the hinge body such that the stay member engages different parts of the friction means as the window moves between fully opened and fully closed positions and the adjustment means enables the frictional resistance to movement of the stay member to have different values at different window positions.

5. A hinge according to claim 4 wherein the friction means comprises a friction plate in the hinge body and engaging the stay member adjacent its end connected to said support means, and spaced adjustable fasteners for adjusting the force with which parts of the friction plate engage the stay member.

6. A hinge according to claim 2 wherein said catch means comprises a catch member spring biased into engagement with said stay member; and manually releasable therefrom.

7. A hinge according to claim 6 wherein said catch member engages the stay member at positions corresponding to the fully open position of the window and to a slightly opened vent position thereof.

8. A hinge according to any one of the preceding claims wherein said support means provides means for ready detachment of the sash of the window from the hinge.

9. A hinge according to claim 8 wherein said support means comprises an element pivotally connected to the hinge body, and a socket for connection to the sash and arranged releasably to receive a part of said element.

10. A hinge according to claim 9 wherein said element is generally of U-shape, having a first limb pivoted to the hinge body, a second limb pivoted to the stay member, and a connecting limb for reception in said socket.

11. A hinge according to claim 6 wherein said catch member is operable from a position on the peripheral frame remote from the hinge.

12. A hinge according to claim 11 wherein said catch member comprises an arm having an end supported in the hinge body with a formation engagable with the stay member, and extending along a member of the peripheral frame to a position at which it is engagable by an operating means.

* * * * *